US009717971B1

(12) United States Patent
Moore

(10) Patent No.: US 9,717,971 B1
(45) Date of Patent: Aug. 1, 2017

(54) CHALK-DISPENSING GOLF TRAINING CLUB

(71) Applicant: Stafford Moore, Thornhill (CA)

(72) Inventor: Stafford Moore, Thornhill (CA)

( * ) Notice: Subject to any disclaimer, the term of this patent is extended or adjusted under 35 U.S.C. 154(b) by 0 days.

(21) Appl. No.: 15/163,113

(22) Filed: May 24, 2016

(51) Int. Cl.
*A63B 69/36* (2006.01)

(52) U.S. Cl.
CPC ..... *A63B 69/3632* (2013.01)

(58) Field of Classification Search
USPC ..... 473/226, 236, 237, 257
See application file for complete search history.

(56) References Cited

U.S. PATENT DOCUMENTS 2,529,771 A * 11/1950 Herman ..... A63B 57/10 473/143
2,804,306 A 8/1957 Chedister
3,037,778 A * 6/1962 Conkling ..... A63B 69/3632 116/211
3,311,377 A * 3/1967 Holbus ..... A63B 69/3632 473/237
3,687,459 A * 8/1972 Swords ..... A63B 69/3632 473/237
5,120,064 A * 6/1992 Cerami ..... A63B 69/3632 473/237
5,620,376 A 4/1997 Hsu
6,361,449 B1 * 3/2002 Holly ..... A63B 24/0006 473/237
D624,126 S 9/2010 Butler
2011/0191058 A1 * 8/2011 Nielsen ..... B65D 83/203 702/130

FOREIGN PATENT DOCUMENTS

WO WO9001357 A1 2/1990

* cited by examiner

*Primary Examiner* — Nini Legesse
(74) *Attorney, Agent, or Firm* — Kyle A. Fletcher, Esq.

(57) ABSTRACT

The chalk-dispensing golf training club is a simulated golf club head that is mounted on a golf club shaft. The chalk-dispensing golf training club is not intended to be used with a golf ball. During training sessions, the chalk-dispensing golf training club is swung as a normal golf club. As the chalk-dispensing golf training club hits the ground, the chalk-dispensing golf training club leaves a chalk mark on the ground which indicates the plane of the swing. Through analysis of the chalk mark, an assessment can be as to whether the swing would result in a straight shot, a draw shot or a slicing shot. This information can be used to adjust the trainee's foot placement and to practice swings with the adjusted foot placement. The chalk dispensing golf training club comprises a practice head, chalk, a shaft, a grip.

16 Claims, 5 Drawing Sheets

CHALK-DISPENSING GOLF TRAINING CLUB

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of practice swingable implements integrally attached to a swingable implement, more specifically, a simulated golf club head for use with a golf club shaft for use in teaching foot placement.

SUMMARY OF INVENTION

The chalk-dispensing golf training club is a simulated golf club head that is mounted on a golf club shaft. The chalk-dispensing golf training club is not intended to be used with a golf ball. During training sessions, the chalk-dispensing golf training club is swung as a normal golf club. As the chalk-dispensing golf training club hits the ground, the chalk-dispensing golf training club leaves a chalk mark on the ground which indicates the plane of the swing. Through analysis of the chalk mark, an assessment can be as to whether the swing would result in a straight shot, a draw shot or a slicing shot. This information can be used to adjust the trainee's foot placement and to practice swings with the adjusted foot placement.

These together with additional objects, features and advantages of the chalk-dispensing golf training club will be readily apparent to those of ordinary skill in the art upon reading the following detailed description of the presently preferred, but nonetheless illustrative, embodiments when taken in conjunction with the accompanying drawings.

In this respect, before explaining the current embodiments of the chalk-dispensing golf training club in detail, it is to be understood that the chalk-dispensing golf training club is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the chalk-dispensing golf training club.

It is therefore important that the claims be regarded as including such equivalent construction insofar as they do not depart from the spirit and scope of the chalk-dispensing golf training club. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
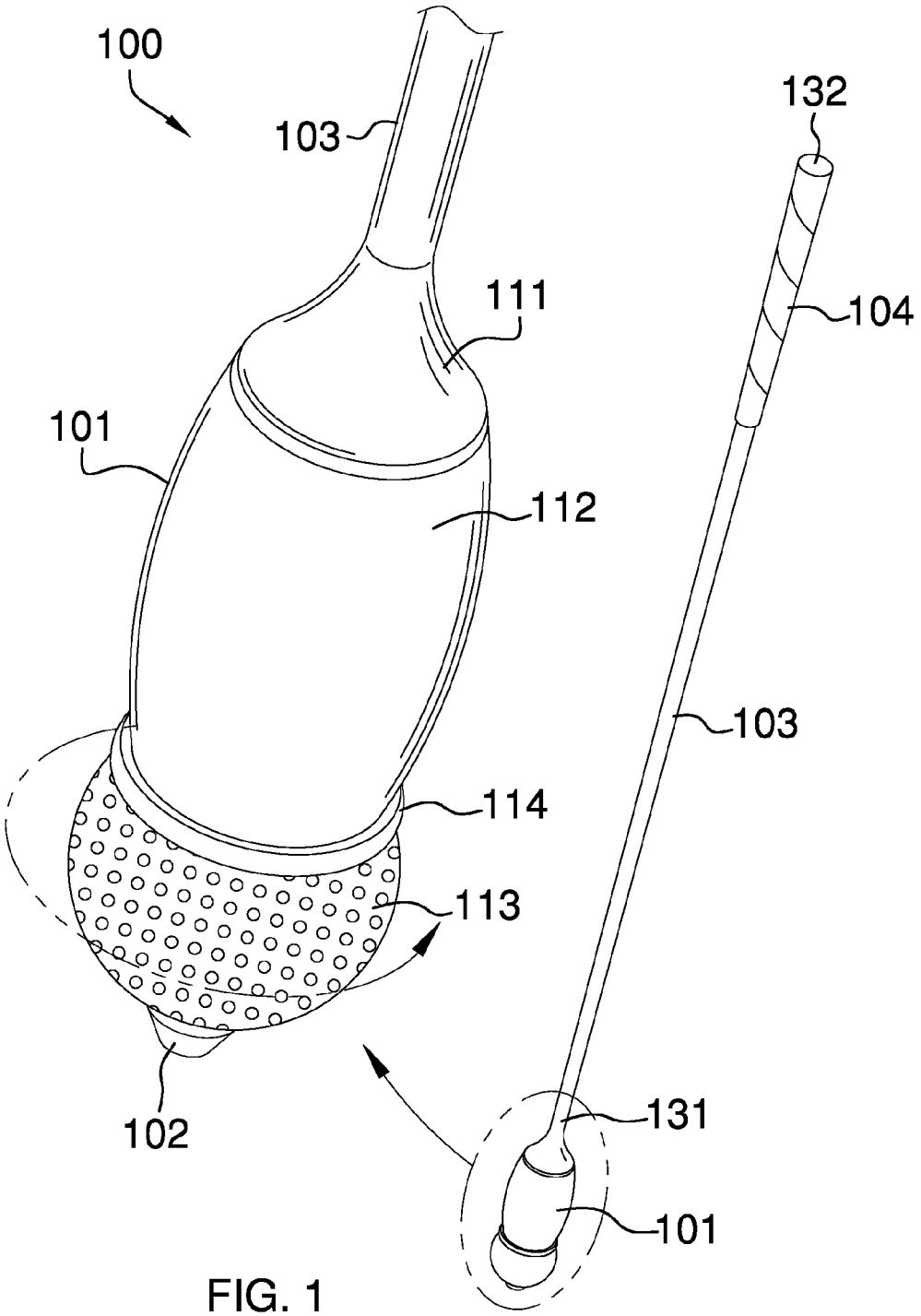
FIG. 1 is a perspective view of an embodiment of the disclosure.
Figure 2:
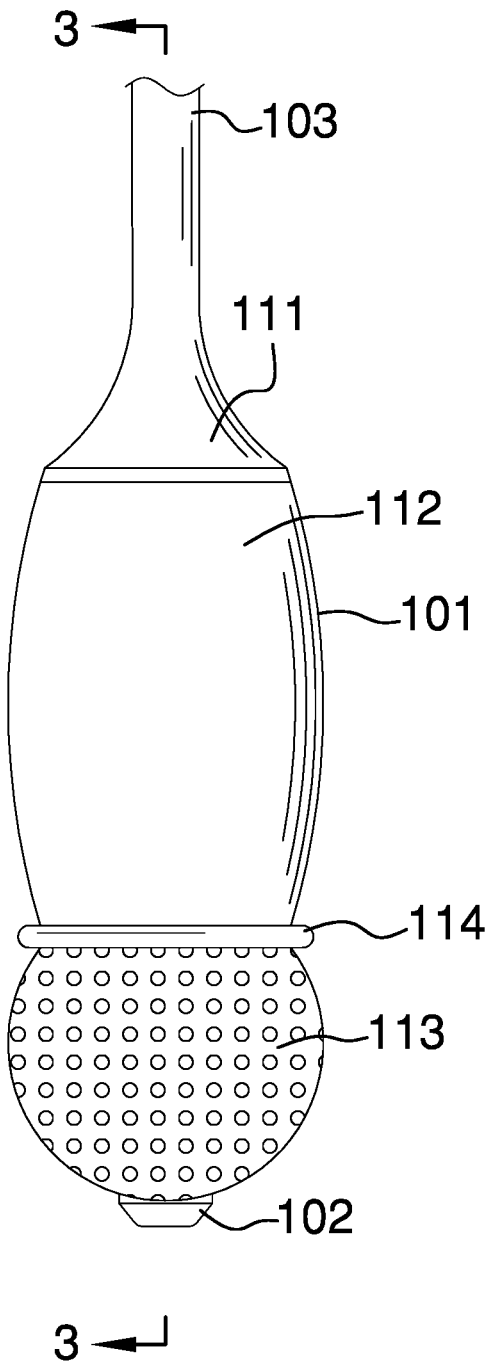
FIG. 2 is a side view of an embodiment of the disclosure.
Figure 3:
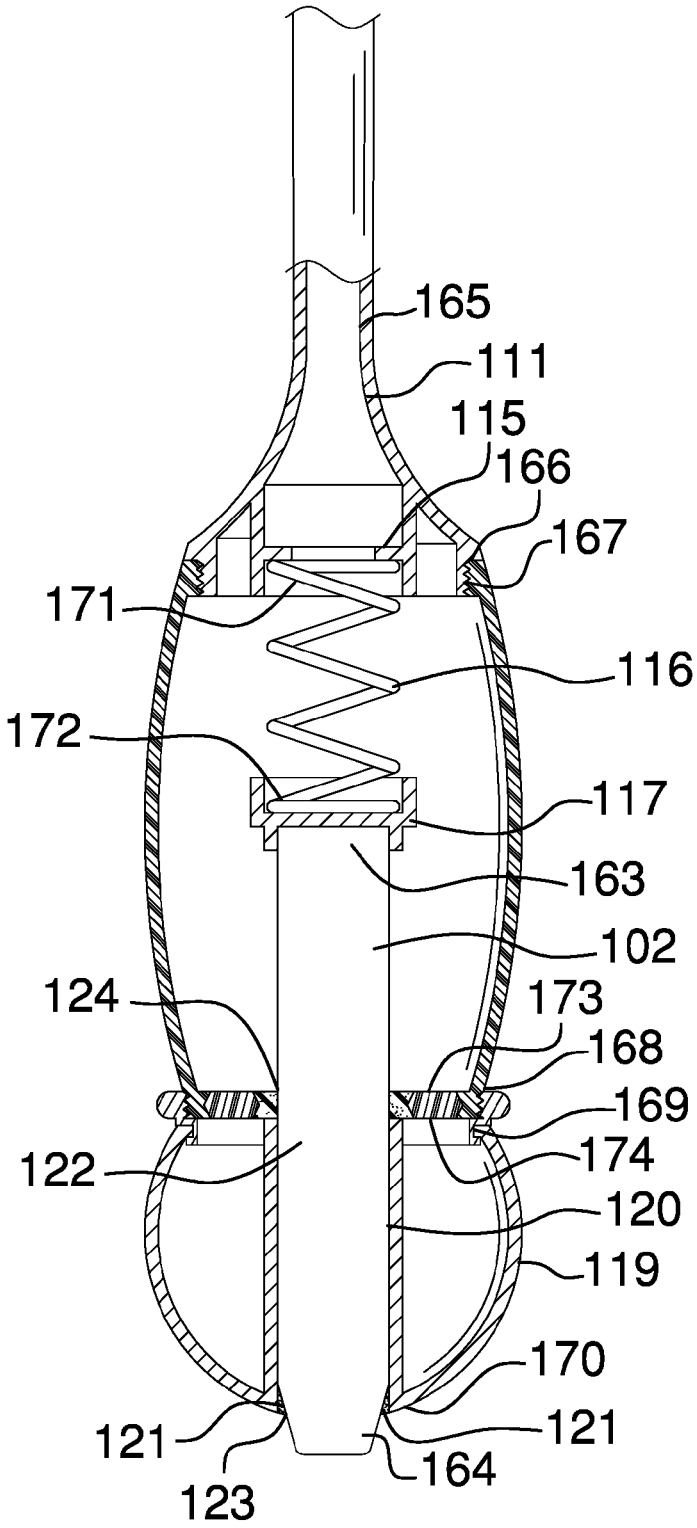
FIG. 3 is a cross-sectional view of an embodiment of the disclosure.
Figure 4:
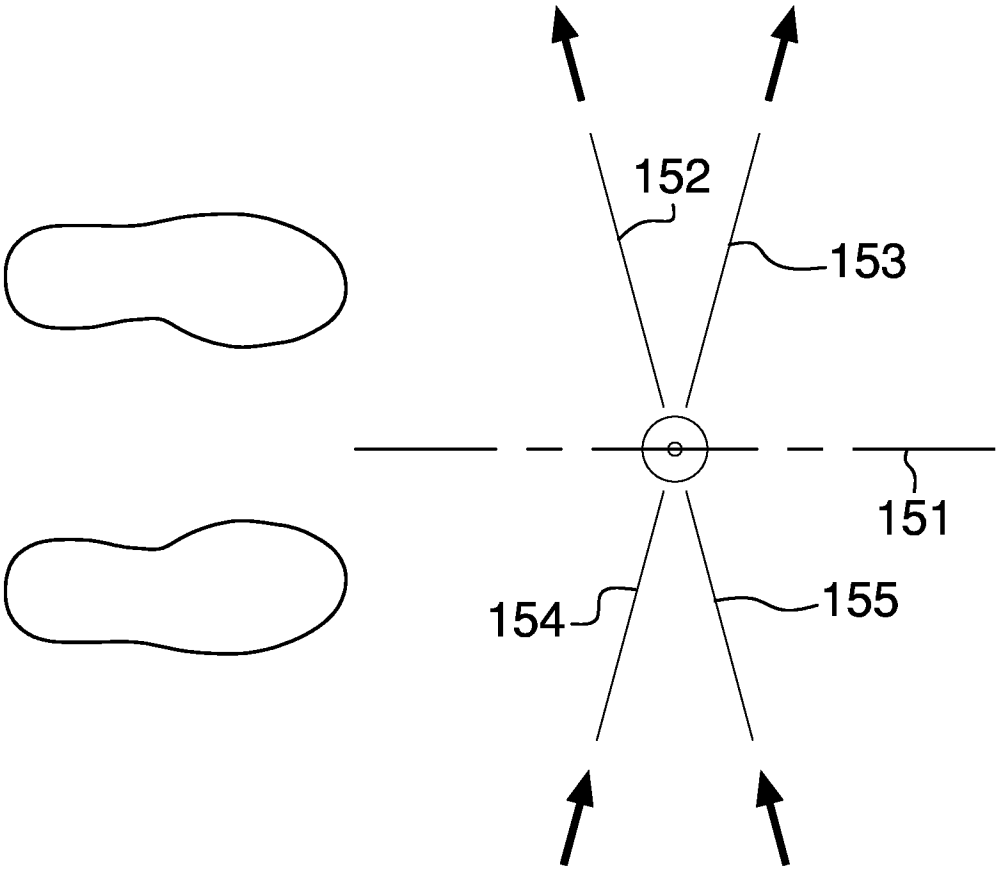
FIG. 4 is a schematic view of an embodiment of the disclosure.
Figure 5:
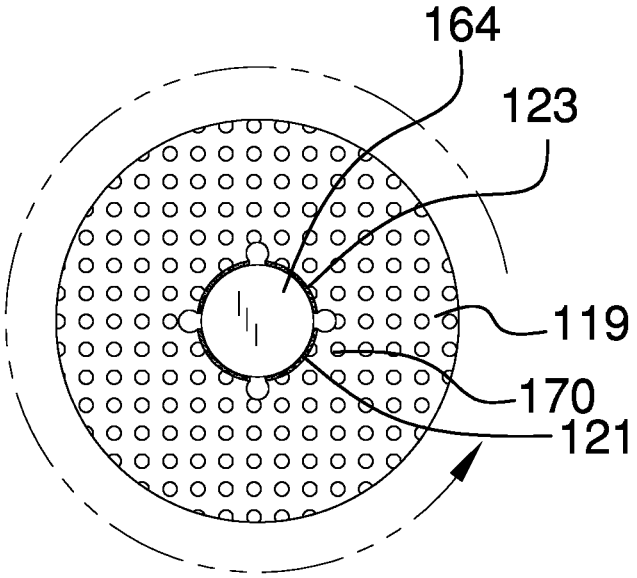
FIG. 5 is an end view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 5. The chalk-dispensing golf training club 100 (hereinafter invention) comprises a practice head 101, chalk 102, a shaft 103, a grip 104.

The shaft 103 is a commercially available golf club shaft that is further defined with a head end 131 and a grip end 132. The practice head 101 mounts on the head end 131 of the shaft 103. The grip 104 mounts on the grip end 132 of the shaft 103. As shown in FIG. 1, the grip 104 is a padded adhesive tape that is wrapped around the shaft 103 near the grip end 132 of shaft 103.

The chalk 102 is a commercially available stick of chalk that is further defined with a third end 163 and fourth end 164. As most clearly shown in FIG. 3, the practice head 101 further comprises a hosel 111, the spring chamber 112, the chalk guide 113, and a locking collar 114.

The hosel 111 is the section of the practice head 101 that attaches the practice head 101 to the head end 131 of the shaft 103. The hosel 111 is a hollow structure that further comprises a spring mount 115, a spring 116, and a chalk grip 117. The hosel 111 is further defined with a fifth end 165 and a sixth end 166. The fifth end 165 attaches to the shaft 103 as if it were a normal golf club head. As the hosel 111 progresses from the fifth end 165 towards the sixth end 166 the side of the hosel 111 flairs away from the center axis of the shaft 103. The sixth end 166 of the hosel 111 is formed with an interior screw thread. The spring mount 115 is attached to the interior surface of the hosel 111. The spring mount 115 anchors the spring 116 in position. The spring 116 is a commercially available helical coil compression spring that is further defined with an eleventh end 171 and a twelfth end 172. The eleventh end 171 of the spring 116 attaches to the spring mount 115. The chalk grip 117 is a clamp that attaches the chalk 102 to the spring 116. The chalk grip 117 attaches to the twelfth end 172 of the spring 116.

The spring chamber 112 provides the space within which the chalk 102 is stored. The spring chamber 112 is a hollow shell that is further defined with a seventh end 167 and an eighth end 168. The seventh end 167 is formed with an external screw thread that is sized to work with the interior screw thread formed in the sixth end 166 of the hosel 111. The eighth end 168 of the spring chamber 112 is formed with an exterior screw thread. The spring chamber 112 is attached to the hosel 111 by screwing the seventh end 167 of the spring chamber 112 into the sixth end 166 of the hosel 111.

The chalk guide 113 guides the chalk 102 to the end of the practice head 101 thereby allowing the practice head 101 to leave a chalk 102 mark on the ground when the invention 100 is swung. The chalk guide 113 further comprises a guide shell 119, a chalk channel 120, and a chalk sharpener 121. The guide shell 119 houses the chalk guide 113 and further comprises a ninth end 169 and a tenth end 170. The guide shell 119 is shaped and textured in the form of a golf ball. Formed in the center of the guide shell 119 is the chalk channel 120. The chalk channel 120 receives the chalk 102 from the spring chamber 112 and guides the chalk 102 in such a way that the chalk 102 can only move in the direction of motion of the spring 116. The chalk channel 120 forms a first hole 122 in the ninth end 169 of the guide shell 119. The chalk channel 120 forms a second hole 123 in the tenth end 170 of the guide shell 119. The ninth end 169 of the guide shell 119 is formed with an exterior screw thread.

The chalk sharpener 121 is integrated into the design of the second hole 123. The chalk sharpener is an annular ring that tapers a portion of the chalk 102 as the chalk 102 descends out of the second hole 123 (see FIG. 3). Moreover, as the fourth end 164 of the chalk 102 exits the second hole 123, the chalk sharpener 121 tapers the fourth end 164 of the chalk 102 such that the chalk 102 is honed for use. The chalk sharpener 121 is a readily and commercially available chalk sharpener.

It shall be noted that adjacent to the second hole 123, a plurality of chalk dust holes 177 is provided. The plurality of chalk dust holes 177 are provided at various locales around the second hole 123 to enable chalk dust to exit as needed. It is envisioned that as the chalk sharpener 121 hones the chalk 102, chalk dust is formed that needs to be released from the invention 100.

The locking collar 114 is a weighted collar that joins the spring chamber 112 and the chalk guide 113. The locking collar 114 is a metal disk. The weight of the metal disk is designed to add weight to the practice head 101 such that the weight of the practice head 101 is the same as the weight of the traditional golf club head. The locking collar 114 is further defined with a thirteenth end 173 and a fourteenth end 174.

An interior screw thread is formed into the thirteenth end 173 of the locking collar 114 such that the exterior screw thread of the eighth end 168 of the spring chamber 112 will screw into the interior screw thread is formed into the thirteenth end 173 of the locking collar 114. An interior screw thread is formed into the fourteenth end 174 of the locking collar 114 such that the exterior screw thread of the ninth end 169 of the chalk guide 113 will screw into the interior screw thread is formed into the fourteenth end 174 of the locking collar 114. The locking collar 114 is formed with a third hole 124 that goes through the locking collar 114 at the center of the disk. The third hole 124 is sized to receive the chalk 102 and aligns with the chalk channel 120.

To use the invention 100, the chalk guide 113 is removed from the locking collar 114 and the locking collar 114 is removed from the spring chamber 112. The chalk 102 is attached to the chalk grip 117. The chalk 102 is inserted through the third hole 124 and the locking collar 114 is reattached to the spring chamber 112. The chalk 102 is inserted through the chalk channel 120 and the chalk guide 113 is reattached to the locking collar 114.

During the practice session, a reference line 151 is drawn from between the golfer's legs to the anticipated swing location of the practice head 101. The invention 100 is then swung as a normal golf club during practice sessions. With the ideal foot placement, the practice head 101 will mark a swing path that is perpendicular to the reference line 151. Should the practice head 101 mark a right inside swing path 154 or a left outside swing path 153 this indicates that the right foot of the golfer is positioned behind the left foot of the golfer. Should the practice head 101 mark a left inside swing path 152 or a right outside swing path 155 this indicates that the left foot of the golfer is positioned behind the right foot of the golfer.

The locking collar 114 is cast from aluminum. The hosel 111, the spring chamber 112 (other than the spring 116), and the chalk guide 113 can be cast from metal or can be molded from plastic. Suitable metal includes but is not limited to aluminum. Suitable plastics include, but are not limited to, high density polyethylene or acrylic poly(methyl methacrylic).

The following definitions were used in this disclosure:

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; or, 4) the point, pivot, or axis around which something revolves.

Center Axis: As used in this disclosure, the center axis is the axis of a cylinder like structure. When the center axes of two cylinder like structures share the same line they are said to be aligned. When the center axes of two cylinder like structures do not share the same line they are said to be offset.

Chalk: As used in this disclosure, chalk is a material made primarily of calcium carbonate that is used for marking on blackboards or other surfaces.

Exterior Screw Thread: An exterior screw thread is a ridge wrapped around the outer surface of a tube in the form of a helical structure that is used to convert rotational movement into linear movement.

Hosel: As used in this disclosure, the hosel is the socket of a golf club head into which the golf club shaft is inserted.

Interior Screw Thread: An interior screw thread is a ridge wrapped around the inner surface of a tube in the form of a helical structure that is used to convert rotational movement into linear movement With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A training device comprising:

a practice head, chalk, a shaft, a grip;

wherein the training device is adapted for use in golf;

wherein the practice head dispenses the chalk, wherein the chalk is dispensed through an aperture formed in a simulated golf ball;

wherein as the shaft is swung in a manner consistent with a golf swing, the chalk leaves a line on a ground surface that indicates the path of the swing plane;

wherein the practice head further comprises a hosel, a spring chamber, a chalk guide, and a locking collar;

wherein the hosel attaches to the shaft;

wherein the hosel is a hollow structure that further comprises a spring mount, a spring, and a chalk grip;

wherein the hosel is further defined with a first end and a second end;

wherein the first end attaches to the shaft;

wherein as the hosel progresses from the first end towards the second end of a side of the hosel flairs away from a center axis of the shaft.

2. The training device according to claim 1 wherein the second end of the hosel is formed with an interior screw thread.

3. The training device according to claim 2 wherein the spring mount is attached to the interior surface of the hosel.

4. The training device according to claim 3 wherein the spring is attached to the spring mount.

5. The training device according to claim 4 wherein the spring is attached to the chalk grip.

6. The training device according to claim 5 wherein the spring chamber is a hollow shell that is further defined with a third end and an fourth end;

wherein the third end is formed with an external screw thread that is sized to work with the interior screw thread;

wherein the fourth end of the spring chamber is formed with an exterior screw thread;

wherein the spring chamber is attached to the hosel by screwing the third end of the spring chamber into the second end of the hosel.

7. The training device according to claim 6 wherein the chalk guide further comprises a guide shell, a chalk channel, and a chalk sharpener; wherein the guide shell houses the chalk channel and the chalk sharpener.

8. The training device according to claim 7 wherein the guide shell is shaped and textured in the form of a golf ball.

9. The training device according to claim 8 wherein the chalk channel is formed in the center of the guide shell.

10. The training device according to claim 9 wherein the chalk channel receives the chalk from the spring chamber and guides the chalk in such a way that the chalk can only move in the direction of motion of the spring.

11. The training device according to claim 10 wherein the locking collar is a weighted collar.

12. The training device according to claim 11 wherein the locking collar is a metal disk;

wherein the weight of the metal disk adds weight to the practice head such that the weight of the practice head is the same as the weight of the traditional golf club head.

13. The training device according to claim 12 wherein the locking collar attaches to the spring chamber;

wherein the locking collar attaches to the chalk guide.

14. The training device according to claim 13 wherein the chalk sharpener is integrated into the design of the second hole; wherein the chalk sharpener is an annular ring that tapers a portion of the chalk as the chalk descends out of the second hole.

15. The training device according to claim 14 where upon as the fourth end of the chalk exits the second hole, the chalk sharpener tapers the fourth end of the chalk such that the chalk is honed for use.

16. The training device according to claim 15 wherein provided adjacent to the second hole is a plurality of chalk dust holes; wherein the plurality of chalk dust holes are provided at various locales around the second hole to enable chalk dust generated via the chalk sharpener to exit as needed.

* * * * *